US011002294B2

(12) United States Patent
Klaassen

(10) Patent No.: US 11,002,294 B2
(45) Date of Patent: May 11, 2021

(54) IMPACT FORCE DISPERSAL ASSEMBLY FOR TURBINE ENGINES AND METHODS OF FABRICATING THE SAME

(71) Applicant: GENERAL ELECTRIC COMPANY, Schenectady, NY (US)

(72) Inventor: Richard Eugene Klaassen, Evendale, OH (US)

(73) Assignee: GENERAL ELECTRIC COMANY, Schenectady, NY (US)

( * ) Notice: Subject to any disclaimer, the term of this patent is extended or adjusted under 35 U.S.C. 154(b) by 367 days.

(21) Appl. No.: 15/288,625

(22) Filed: Oct. 7, 2016

(65) Prior Publication Data

US 2018/0100519 A1 Apr. 12, 2018

(51) Int. Cl.

| | |
|---|---|
| ***F04D 29/66*** | (2006.01) |
| ***F04D 29/52*** | (2006.01) |
| ***F04D 19/00*** | (2006.01) |
| ***F04D 29/02*** | (2006.01) |

(52) U.S. Cl.
CPC ..... *F04D 29/668* (2013.01); *F04D 19/002* (2013.01); *F04D 29/023* (2013.01); *F04D 29/522* (2013.01); *F04D 29/526* (2013.01)

(58) Field of Classification Search
CPC ..... F04D 29/668; F01D 21/045
See application file for complete search history.

(56) References Cited

U.S. PATENT DOCUMENTS

| | | | | |
|---|---|---|---|---|
| 5,336,044 A | | 8/1994 | Forrester | |
| 5,403,148 A | | 4/1995 | Forrester | |
| 5,533,865 A | * | 7/1996 | Dassen | F03D 1/0608 244/200 |
| 6,290,455 B1 | | 9/2001 | Hemmelgarn et al. | |
| 6,814,541 B2 | * | 11/2004 | Evans | B29C 33/40 415/200 |
| 7,246,990 B2 | * | 7/2007 | Xie | F01D 21/045 415/173.4 |
| 9,248,612 B2 | | 2/2016 | Zhu et al. | |
| 10,337,350 B2 | * | 7/2019 | Thomas | F01D 21/045 |
| 2004/0146393 A1 | | 7/2004 | Evans et al. | |
| 2007/0081887 A1 | | 4/2007 | Xie et al. | |
| 2008/0152853 A1 | | 6/2008 | Blanton et al. | |
| 2015/0267556 A1 | * | 9/2015 | Thomas | F01D 21/045 415/9 |
| 2018/0100519 A1 | | 4/2018 | Klaassen | |

FOREIGN PATENT DOCUMENTS

| | | |
|---|---|---|
| CN | 104105848 A | 10/2014 |
| CN | 203962813 U | 11/2014 |
| CN | 107916992 A | 4/2018 |
| EP | 1406844 A | 9/1975 |

OTHER PUBLICATIONS

Machine Translated Chinese Office Action Corresponding to Application No. 201710913673.X dated Aug. 22, 2019.

* cited by examiner

*Primary Examiner* — Courtney D Heinle
*Assistant Examiner* — John S Hunter, Jr.
(74) *Attorney, Agent, or Firm* — Dority & Manning, P.A.

(57) ABSTRACT

A composite fan casing for a turbine engine includes a core including a plurality of core layers of reinforcing fiber bonded together with a resin. The core includes a first surface and an opposing second surface. The fan casing also includes a shock dispersion panel coupled to the first surface, wherein the shock dispersion panel is configured to disperse a shock wave caused by an impact on the second surface to prevent separation of the plurality of core layers.

20 Claims, 4 Drawing Sheets

IMPACT FORCE DISPERSAL ASSEMBLY FOR TURBINE ENGINES AND METHODS OF FABRICATING THE SAME

BACKGROUND

This disclosure relates generally to turbine engines, and more particularly, to composite fan containment casings used with turbine engines and methods for fabricating such casings.

At least some known gas turbine engines include high and low pressure compressors, a combustor, and at least one turbine. The compressors compress air which is mixed with fuel and channeled to the combustor. The fuel/air mixture is then ignited to generate hot combustion gases, which are channeled to the turbine.

When engines operate in various conditions, foreign objects may be ingested into the engine. More specifically, various types of foreign objects, ranging from large birds, such as sea gulls, to hailstones, sand and rain, may be entrained in the inlet of a gas turbine engine. The foreign objects may impact a blade causing a portion of the impacted blade to be torn loose from a rotor. Such a condition, known as foreign object damage, may cause the rotor blade to impinge upon the fan casing which may result in cracks along an exterior surface of the fan casing, and/or possible injury to nearby personnel. To facilitate preventing fan casing damage and injuries to personnel, at least some known engines include a casing shell to facilitate preventing crack propagation under impact loading and to facilitate reducing stresses near the engine casing penetration.

However, any time a high velocity projectile impacts a fan case, a shock wave is generated. This shock wave behaves like an impulsive, ultrasonic wave, and travels in a composite part at 10 times the speed of sound in air. This shock wave initially travels as a compressive wave through at least some known fan cases without negative effects. However, when the wave encounters an air-backed interface, such as the outer diameter of the fan case, it inverts into a tensile wave. In at least some known fan cases, the resulting tensile wave can crack the composite fan case. This crack occurs on the order of 10 microseconds after the impact, at which time the fan case has only flexed a very small amount. As such, at least some known fan cases can crack before the momentum of the projectile has stressed the fan case. The shock wave has not historically been incorporated into known fan case design, and fan cases have been designed with larger thicknesses to reduce damage, which increases the weight of the fan case.

BRIEF DESCRIPTION

In one aspect, an impact force dispersal assembly is provided. The impact force dispersal assembly includes a structural panel including a first surface and an opposing second surface. The impact force dispersal assembly also includes a shock dispersion panel coupled to the first surface, wherein the shock dispersion panel is configured to disperse a shock wave caused by an impact on the second surface.

In another aspect, a composite fan casing for a turbine engine is provided. The fan casing includes a core including a plurality of core layers of reinforcing fiber bonded together with a resin. The core includes a first surface and an opposing second surface. The fan casing also includes a shock dispersion panel coupled to the first surface, wherein the shock dispersion panel is configured to disperse a shock wave caused by an impact on the second surface to prevent separation of the plurality of core layers.

In yet another aspect, a method of assembling a composite fan casing for a turbine engine is provided. The method includes providing a core including a plurality of core layers of reinforcing fiber bonded together with a resin, wherein the core includes a first surface and an opposing second surface. The method also includes coupling a shock dispersion panel to the first surface. The shock dispersion panel is configured to disperse a shock wave caused by an impact on the second surface to prevent separation of the plurality of core layers

DETAILED DESCRIPTION

Figure 1:
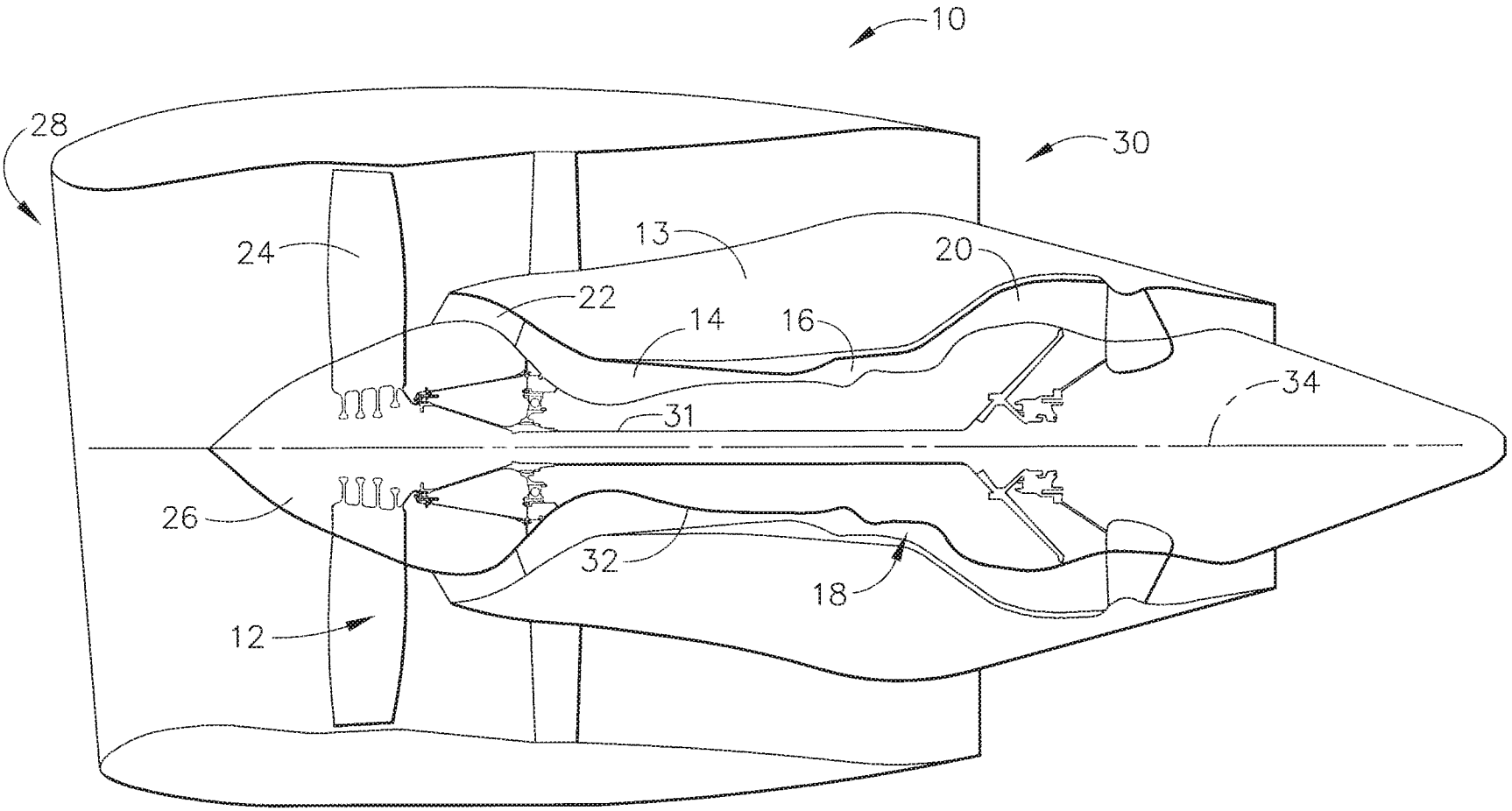
FIG. 1 is a schematic illustration of an exemplary gas turbine engine.

In the following specification and claims, reference will be made to a number of terms, which shall be defined to have the following meanings.

The singular forms "a," "an," and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "on the order of, "about," "approximately," and "substantially," are not to be limited to the precise value specified. In at least some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise.

As used herein, the terms "axial" and "axially" refer to directions and orientations that extend substantially parallel to a centerline of an engine. Moreover, the terms "radial" and "radially" refer to directions and orientations that extend substantially perpendicular to the centerline of the engine. In addition, as used herein, the terms "circumferential" and "circumferentially" refer to directions and orientations that extend arcuately about the centerline of the engine.

Embodiments of a turbine engine provide an impact force dispersal assembly that facilitates reducing the weight and increasing the durability of a fan case with respect to blade-out events, bird ingestion or ice ingestion. Specifically, the impact force dispersal assembly includes composite fan casing including a core formed from a plurality of core layers of reinforcing fiber bonded together with a resin. The composite fan casing also includes a shock dispersion panel coupled thereto. The shock dispersion panel is configured to disperse a shock wave caused by an impact on the casing core to prevent separation of the plurality of core layers. More specifically, the shock dispersion panel disperses an initial compressive wave to prevent reflection as a tensile wave and, therefore, prevents the separation. By dispersing the shock wave and preventing layer separation, the shock dispersion panel enables the casing to maintain its strength for impact by the debris. Furthermore, shock dispersion panel includes a sawtooth-shaped cross-section and is made from the same material as the casing such that the shock dispersion panel and the casing have the same acoustic impedance. In another embodiment, the shock dispersion panel is made from a material having a higher acoustic impedance that the casing. Inclusion of the shock dispersion panel in the impact force dispersal assembly enables for a thinner fan casing and/or impingement panel, which reduces the overall weight of the engine.

Referring to the drawings, FIG. 1 is a schematic illustration of an exemplary gas turbine engine 10 that includes a fan assembly 12 and a core engine 13 including a high pressure compressor 14 and a combustor 16. Engine 10 also includes a high pressure turbine 18, a low pressure turbine 20 and a booster 22. Fan assembly 12 includes an array of fan blades 24 extending radially outward from a rotor disc 26. Engine 10 has an intake side 28 and an exhaust side 30. Fan assembly 12 and turbine 20 are coupled by a first rotor shaft 31, and compressor 14 and turbine 18 are coupled by a second rotor shaft 32.

During operation, air flows through fan assembly 12, along a central axis 34, and compressed air is supplied to high pressure compressor 14. The highly compressed air is delivered to combustor 16. Airflow (not shown in FIG. 1) from combustor 16 drives turbines 18 and 20, and turbine 20 drives fan assembly 12 by way of shaft 31.

Figure 2:
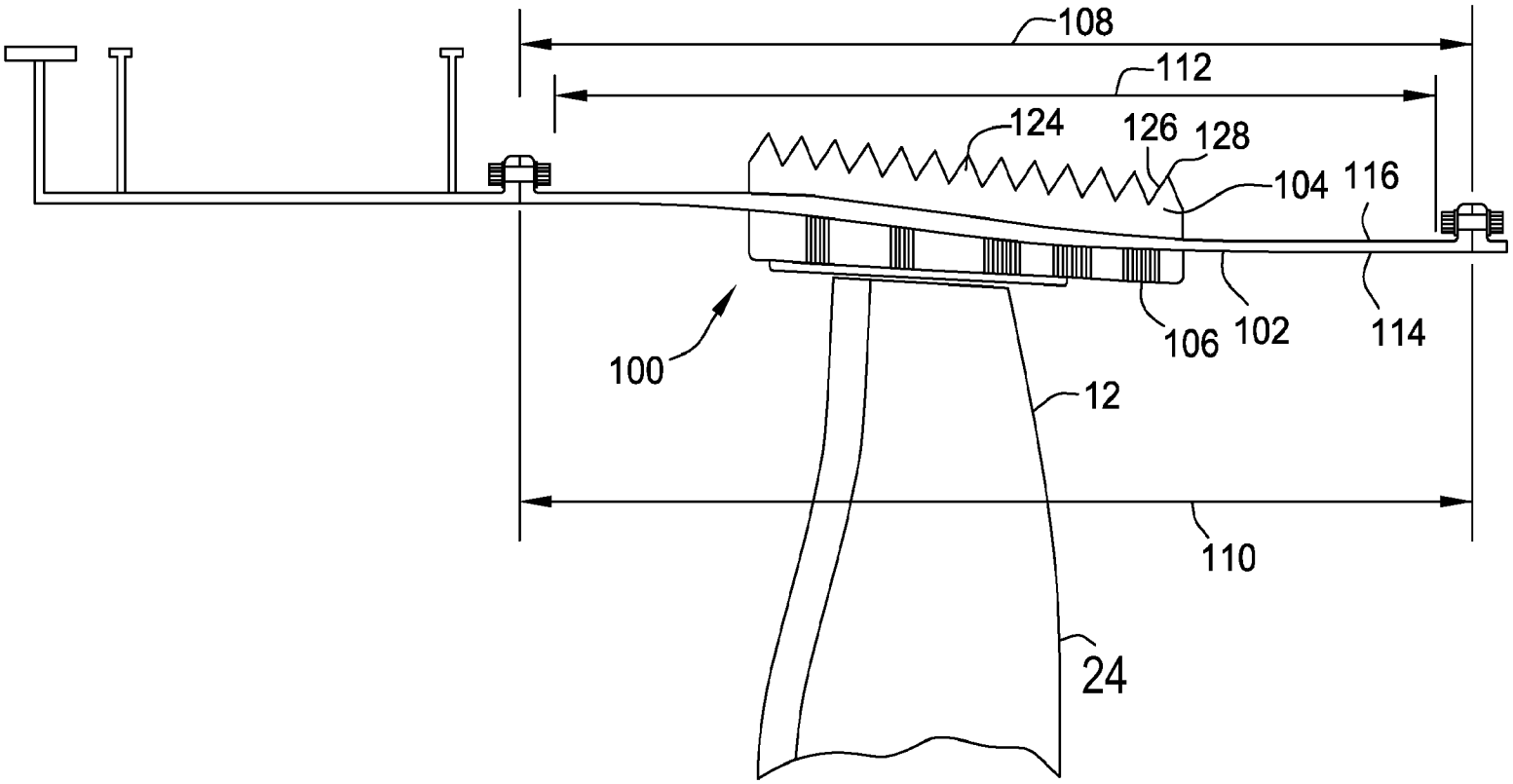
FIG. 2 is a cross-sectional view of an exemplary impact force dispersal assembly that may be used with the gas turbine engine shown in FIG. 1.
Figure 3:
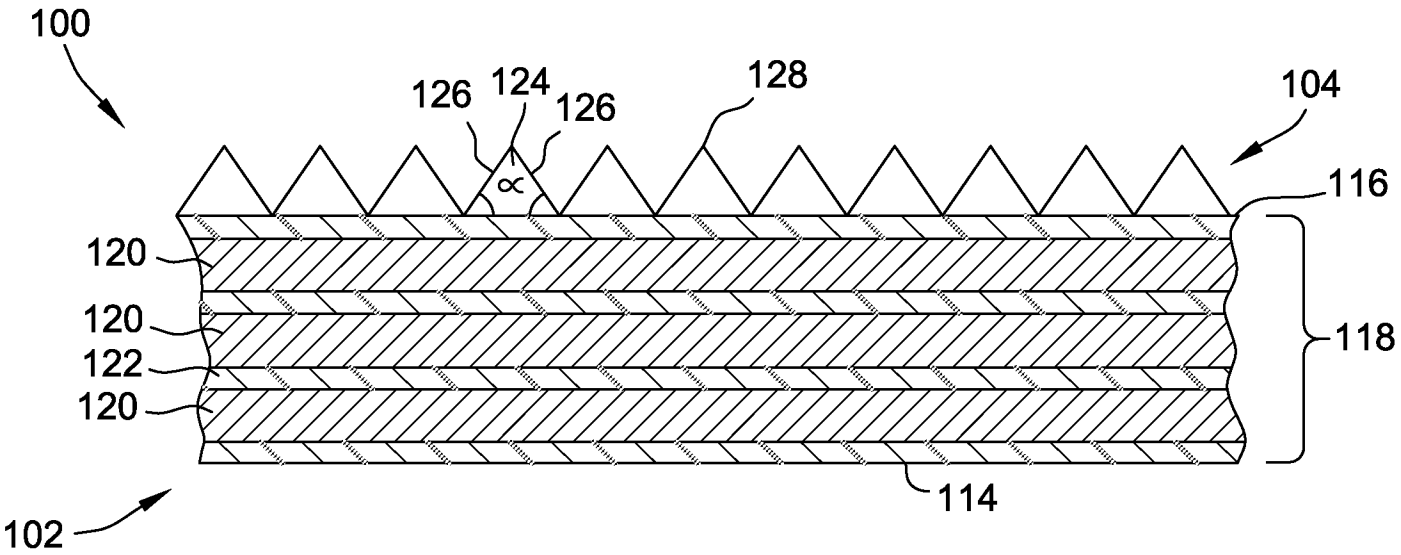
FIG. 3 is an enlarged schematic cross-sectional view of an exemplary fan case that may be used with the impact force dispersal assembly shown in FIG. 2.

FIG. 2 is an enlarged schematic cross-sectional view of an exemplary impact force dispersal assembly 100 including a fan containment casing 102, a shock dispersion panel 104, and an impingement panel 106. FIG. 3 is an enlarged schematic cross-sectional view of fan case 102 that may be used with the impact force dispersal assembly 100. As described herein, impingement panel 106 is configured to prevent fan blades 24 from impinging or penetrating casing 102 and shock dispersion panel 104 is configured to disperse a shock wave caused by blade impacting at least one of casing 102 and impingement panel 106. In the exemplary embodiment, engine containment casing 102 is a hardwall containment system having a length 108 that is selected to be approximately equal to a fan assembly length 110. More specifically, length 108 is selected to ensure fan containment case 102 substantially circumscribes a prime containment width 112 of fan assembly 12. As used herein, the prime containment width 112 is defined by a zone that extends both axially and circumferentially around fan assembly 12 in an area where a fan blade, such as blade 24 is most likely to be ejected from fan assembly 12.

Although shock dispersion panel 104 and impingement panel 106 are shown in FIG. 2 as having equal lengths, it is contemplated that shock dispersion panel 104 and impingement panel 106 may have any lengths, including different lengths, that facilitates operation of impact force dispersal assembly 100 as described herein. For example, shock dispersion panel 104 includes a length equal to one of fan assembly length 110 or prime containment width 112.

In the exemplary embodiment, containment casing 102 includes a first or inner surface 114 and a second or outer surface 116. Furthermore, shock dispersion panel 104 is coupled to outer surface 116 of containment casing 102, and impingement panel 106 is coupled to inner surface 114 of containment casing 102. Shock dispersion panel 104 facilitates dispersing energy from a shock wave caused by impingement of debris (e.g. ice, a bird, or a fan blade) on inner surface 114. More specifically, shock dispersion panel 104 disperses the shock wave before the shock wave can damage casing 102. As described above, when debris impacts an inner surface of at least some known fan casings, a compressive shock wave travels through the casing and reflects off the exposed outer surface as a tensile wave, which may cause a crack in the casing. The crack weakens the casing such that when the full momentum of the debris impacts the casing, a greater amount of damage may occur than if the crack were not already present. Accordingly, shock dispersion panel 104, as described herein, disperses the initial compressive wave to prevent reflection as a tensile wave and, therefore, prevents the formation of a crack in casing 102.

Referring now to FIG. 3, in the exemplary implementation, casing 102 includes a core 118 that is fabricated in part by a plurality of core layers 120 of reinforcing fibers. Moreover, in the exemplary embodiment, core layers 120 of reinforced fibers are bonded together by a thermoset resin 122. Any suitable reinforcing fiber can be used to form the fibers in core layers 120, including, but not limited to, glass fibers, graphite fibers, carbon fibers, ceramic fibers, aromatic polyamid fibers, for example poly(p-phenylenetherephtalamide) fibers (KEVLAR® fibers), and mixtures thereof Any suitable thermosetting polymeric resin 122 can be used in forming core 118, for example, vinyl ester resin, polyester resins, acrylic resins, epoxy resins, polyurethane resins, polyimide, bismaleimide, and mixtures thereof.

Furthermore, impingement panel 106 (shown in FIG. 2) is an optional feature of impact force dispersal assembly 100 and is therefore not shown in FIG. 3 as an example of impact force dispersal assembly 100 without impingement panel 106.

As shown in FIG. 3, shock dispersion panel 104 includes a plurality of adjacent triangular members 124 coupled to outer surface 116 of casing core 118. In the exemplary embodiment, each member 124 includes a pair of opposing sidewalls 126 such that each sidewall 126 is oriented at an angle a within a range of approximately 30 degrees to approximately 80 degrees with respect to outer surface 116. More specifically, each sidewall 126 is oriented at an angle a within a range of approximately 50 degrees to approximately 70 degrees with respect to outer surface 116. Even more specifically, each sidewall 126 is oriented at an angle a within a range of approximately 55 degrees to approximately 65 degrees with respect to outer surface 116. In one embodiment, each sidewall 126 is oriented at an angle a that is approximately 60 degrees with respect to outer surface 116. Furthermore, in the configuration shown in FIG. 2, sidewalls 126 terminate approximately halfway between outer surface 116 and a peak 128 of each triangular member 124. Alternatively, as shown in FIG. 3, sidewalls 126 terminate proximate outer surface 116 such that sidewalls 126 of adjacent members 124 nearly intersect. In either configuration, shock dispersion panel 104 includes a substantially sawtooth-shaped cross section.

In the exemplary embodiment, members 124 of shock dispersion panel 104 are formed from the same material as core 118. More specifically, shock dispersion panel 104 is formed from a plurality of layers bonded together by resin. As such, shock dispersion panel 104 and core 118 of casing 102 have a substantially similar acoustic impedance such that sound waves traveling through shock dispersion panel 104 behave substantially similarly as sound waves traveling through core 118 of casing 102. As used herein, the term "acoustic impedance" is meant to describe the ratio of the pressure in a sound wave through a material to the rate of particle flow through the material. To put another way, "acoustic impedance" can be approximated as the product of a material's density and modulus. When a sound wave travels through two materials with the same acoustic impedance, the wave continues across the seam between the two materials and does not reflect off of the seam back into the first material. As such, a shock wave traveling through core 118 of casing 102 continues past outer surface 116 and into shock dispersion panel 104 such that shock dispersion panel 104, and more specifically, members 124, disperses the shock wave caused by an impact on inner surface 114 to prevent separation of plurality of core layers 120.

Figure 4:
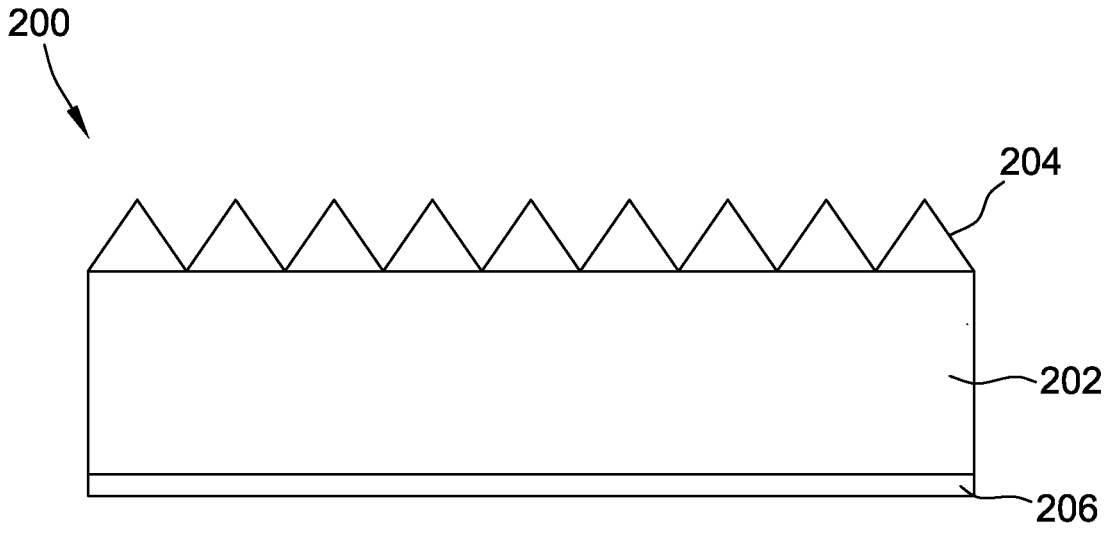
FIG. 4 is an enlarged schematic cross-sectional view of an alternative impact force dispersal assembly at may be used with the gas turbine engine shown in FIG. 1.

FIG. 4 is an enlarged schematic cross-sectional view an alternative impact force dispersal assembly 200 that may be used with gas turbine engine 10 (shown in FIG. 1). Impact force dispersal assembly 200 includes a structural panel 202, a shock dispersion panel 204, and an impingement panel 206. In such an embodiment, structural panel 202 is formed from a solid, homogeneous material, such as but not limited to, a metallic material. In impact force dispersal assembly 200, shock dispersion panel 204 is also formed from the same solid, homogeneous material such that the acoustic impedances of structural panel 202 and shock dispersion panel 204 are substantially similar. Similar to impact force dispersal assembly 100, impingement panel 206 is an optional feature of impact force dispersal assembly 200. With the exception of the materials from which structural panel 202 and shock dispersion panel 204 are made, structural panel 202 and shock dispersion panel 204 are substantially similar in form and function to structural panel 102 and shock dispersion panel 104 of impact force dispersal assembly 100 (shown in FIG. 3). As described above, the shape of shock dispersion panel 204, made from the same material as panel 202 and having the same acoustic impedance, facilitates dispersing a shock wave traveling through structural panel 202 to prevent damage to structural panel 202.

Figure 5:
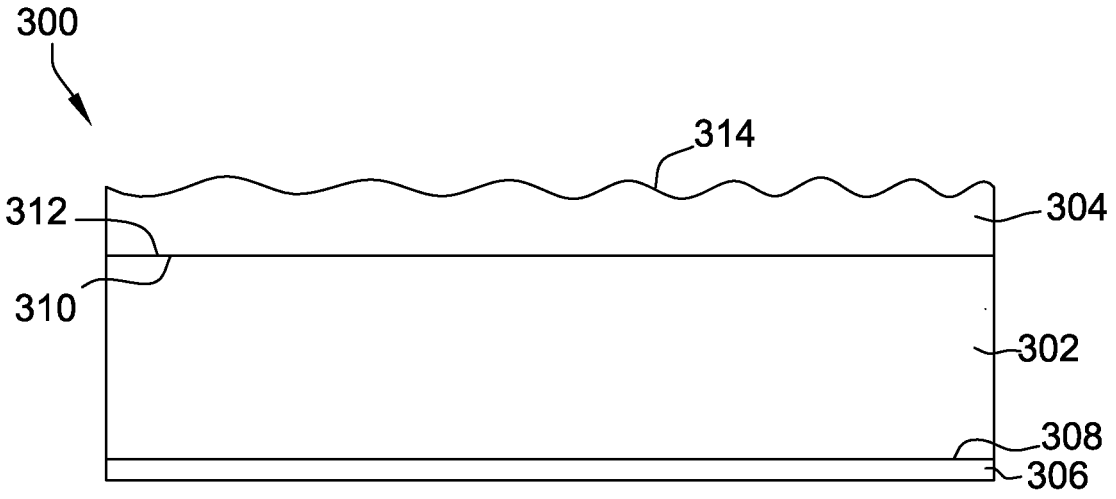
FIG. 5 is a cross-sectional view of another alternative impact force dispersal assembly that may be used with the gas turbine engine shown in FIG. 1.

FIG. 5 is a cross-sectional view of another alternative impact force dispersal assembly 300 that may be used with gas turbine engine 10 (shown in FIG. 1). Impact force dispersal assembly 300 includes a structural panel 302, a shock dispersion panel 304, and an impingement panel 306. In impact force dispersal assembly 300, shock dispersion panel 304 is formed from the same material as structural panel 302. The material includes a plurality of alternating fiber layers and resin, or a solid metallic material. Generally, shock dispersion panel 304 and structural panel 302 are formed from any material having substantially similar acoustic impedances such that sound waves traveling through shock dispersion panel 304 behave substantially similarly as sound waves traveling through structural panel 302 to facilitate operation of impact force dispersal assembly 300 as described herein.

As shown in FIG. 5, structural panel 302 includes an inner surface 308 coupled to optional impingement panel 306 and an outer surface 310 coupled to shock dispersion panel 304. More specifically, shock dispersion panel 304 includes an inner surface 312 coupled to outer surface 310 and an opposing distal outer surface 314. In impact force dispersal assembly 300, outer surface 314 is wavy such that shock dispersion panel 304 includes a wavy cross-sectional shape rather than the sawtooth-shape of shock dispersion panels 104 and 204. Similar to shock dispersion panel 104, shock dispersion panel 304 facilitates dispersing energy from a shock wave caused by impingement of debris (e.g. ice, a bird, or a fan blade) on inner surface 306 or on impingement panel 306. More specifically, shock dispersion panel 304 disperses the shock wave before the shock wave can damage structural panel 302. Accordingly, shock dispersion panel 304, as described herein, disperses the initial compressive wave to prevent reflection as a tensile wave and, therefore, prevents the formation of a crack in structural panel 302.

Figure 6:
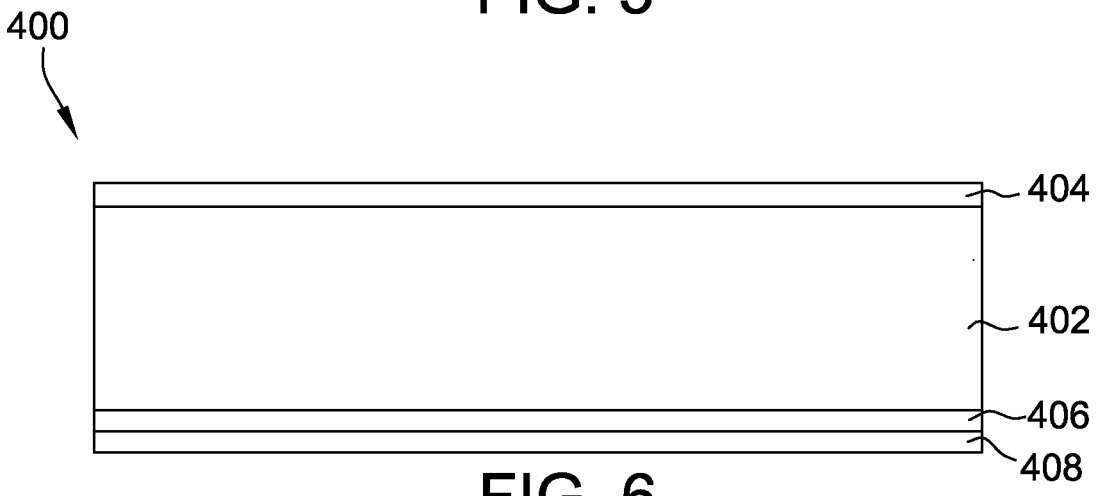
FIG. 6 is a cross-sectional view of yet another alternative impact force dispersal assembly that may be used with the gas turbine engine shown in FIG. 1.

FIG. 6 is a cross-sectional view of another alternative impact force dispersal assembly 400 that may be used with gas turbine engine 10 (shown in FIG. 1). Impact force dispersal assembly 400 includes a structural panel 402, a first shock dispersion panel 404, a second shock dispersion panel 406, and an optional impingement panel 408. In impact force dispersal assembly 400, shock dispersion panels 404 and 406 are formed from a different material than structural panel 402. More specifically, shock dispersion panels 404 and 406 include a substantially flat plate of a material having a first acoustic impedance, and structural panel 402 is formed from a material having a different second acoustic impedance that is less than the acoustic impedance of shock dispersion panels 404 and 406. For example, structural panel 402 is formed from a plurality of alternating fiber layers and resin, similar to fan casing 102 (shown in FIGS. 1-3), and shock dispersion panels 404 and 406 are formed from a metallic material having a higher acoustic impedance than the composite material of structural panel 402, such as but not limited to, a metallic material. Generally, structural panel 402 and shock dispersion panels 404 and 406 are formed from any material on the condition that shock dispersion panels 404 and 406 are formed from a material having a higher acoustic impedance than structural panel 402. Furthermore, in the exemplary embodiment, impingement panel 408 is also formed from a material having a higher acoustic impedance than structural panel 402. However, impingement panel 408 may be formed from any material that facilitates operation of assembly 400 as described herein.

In operation, shock dispersion panels 404 and 406 facilitate dispersing energy from a shock wave caused by impingement of debris (e.g. ice, a bird, or a fan blade) on shock dispersion panel 406 or on impingement panel 406. Although shock dispersion panel 406 is shown in FIG. 6 as positioned between structural panel 402 and impingement panel 408, impingement panel 408 may be positioned between structural panel 402 and shock dispersion panel 406. Shock dispersion panels 404 and 406 disperses the shock wave to prevent the shock wave from damaging structural panel 402. When a sound wave travels through two materials with different acoustic impedances, the wave reflects off the seam between the two materials back into the first material. However, when the material off of which the sound wave reflect is of a higher acoustic impedance than the material into which the sound wave is reflected, the sound wave remains a compressive wave and does not invert into a tensile wave. For example, a shock wave traveling through structural panel 402 made from alternating layers of fibers and resin reflects off of shock dispersion panel 404 made of a metallic material as a compressive wave, which again passes through structural panel 402 without effect. The wave then reflects off shock dispersion panel 406 as a compressive wave back into structural panel 402. As such, shock dispersion panels 404 and 406 disperse the shock wave caused by an impact on shock dispersion panel 406 or on impingement panel 406 to prevent separation of alternating layers of fibers and resin. Furthermore, in embodiments having impingement panel 406, the shock wave then reflects off of panel 406 because of its acoustic impedance being higher than that of structural panel 402. As a result, the shock wave reflects between panels 404 and 406 until it dissipates, and separation of the layers of structural panel 402 is prevented.

The above-described embodiments of a turbine engine provide an impact force dispersal assembly that facilitates reducing the weight and increasing the durability of a fan case with respect to blade-out events, bird ingestion or ice ingestion. Specifically, the impact force dispersal assembly includes composite fan casing including a core formed from a plurality of core layers of reinforcing fiber bonded together with a resin. The composite fan casing also includes a shock dispersion panel coupled thereto. The shock dispersion panel is configured to disperse a shock wave caused by an impact on the casing core to prevent separation of the plurality of core layers. More specifically, the shock dispersion panel disperses an initial compressive wave to prevent reflection as a tensile wave and, therefore, prevents the separation. By dispersing the shock wave and preventing layer separation, the shock dispersion panel enables the casing to maintain its strength for impact by the debris. Furthermore, shock dispersion panel includes a sawtooth-shaped cross-section and is made from the same material as the casing such that the shock dispersion panel and the casing have the same acoustic impedance. In another embodiment, the shock dispersion panel is made from a material having a higher acoustic impedance that the casing. Inclusion of the shock dispersion panel in the impact force dispersal assembly enables for a thinner fan casing and/or impingement panel, which reduces the overall weight of the engine.

An exemplary technical effect of the methods, systems, and apparatus described herein includes at least one of: (a) increasing the safety of the engine during blade-out events, bird ingestion or ice ingestion; (b) increasing the service lifetime of the fan casing; (c) decreasing engine weight; (d) increasing engine efficiency; and (e) reducing maintenance and labor costs associated with the engine.

Exemplary embodiments of methods, systems, and apparatus for impact force dispersal assembly are not limited to the specific embodiments described herein, but rather, components of the systems and/or steps of the methods may be utilized independently and separately from other components and/or steps described herein. For example, the methods may also be used in combination with other systems requiring impact force dispersal assemblies and the associated methods, and are not limited to practice with only the turbine engine systems and methods as described herein. Rather, the exemplary embodiment can be implemented and utilized in connection with many other applications, equipment, and systems that may benefit from impact force dispersal assemblies.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An impact force dispersal assembly comprising:

a structural panel comprising a first surface and an opposing second surface; and a shock dispersion panel coupled to said first surface, the shock dispersion panel comprising a plurality of solid members having a solid exterior and a solid central interior, wherein said shock dispersion panel is configured to disperse a shock wave caused by an impact on said second surface, wherein the plurality of solid members extend radially outward from the first surface.

2. The assembly in accordance with claim 1, wherein said shock dispersion panel comprises a sawtooth-shaped cross-section.

3. The assembly in accordance with claim 1, wherein said plurality of solid members each comprise at least one sidewall oriented within a range of 30 degrees to 80 degrees with respect to said first surface.

4. The assembly in accordance with claim 1, wherein said shock dispersion panel is formed from a first material and said structural panel is formed from a second material that is the same as the first material.

5. The assembly in accordance with claim 1, wherein said shock dispersion panel is formed from a first material having a first acoustic impedance and said structural panel is formed from a second material having a second acoustic impedance lower than the first acoustic impedance.

6. The assembly in accordance with claim 1, wherein said shock dispersion panel is formed from a first material having a first acoustic impedance and said structural panel is formed from a second material having a second acoustic impedance that is the same as the first acoustic impedance.

7. The assembly in accordance with claim 1, wherein the solid central interior does not include any hollow portions, and wherein the solid members are formed from an alternating arrangement of resin and layers of reinforcing fiber.

8. The assembly in accordance with claim 1, wherein said structural panel forms a portion of a fan casing for a gas turbine engine.

9. The assembly in accordance with claim 8, wherein the plurality of solid members each have a triangle cross-section extending radially outward from the fan casing.

10. A composite fan casing for a turbine engine, said fan casing comprising:

a core comprising a plurality of core layers of reinforcing fiber bonded together with a resin, said core comprising an outer surface and an opposing inner surface; and a shock dispersion panel coupled to said outer surface, the shock dispersion panel comprising a plurality of solid members having a solid exterior and a solid central interior, wherein said shock dispersion panel is configured to disperse a shock wave caused by an impact on said inner surface to prevent separation of said plurality of core layers, and wherein the plurality of solid members extend radially outward from the outer surface.

11. The fan casing in accordance with claim 10, wherein said shock dispersion panel comprises a plurality of panel layers of reinforcing fiber bonded together with the resin such that said shock dispersion panel and said core are formed from the same material.

12. The fan casing in accordance with claim 10, wherein the shock dispersion panel is formed from a first material having a first acoustic impedance and the core is formed from a second material having a second acoustic impedance, wherein the first acoustic impedance is higher than the second acoustic impedance.

13. The fan casing in accordance with claim 10, wherein said plurality of solid members each comprise at least one sidewall oriented within a range of 30 degrees to 80 degrees with respect to said outer surface.

14. The fan casing in accordance with claim 10, further comprising an impingement panel coupled to said inner surface opposite said shock dispersion panel.

15. A method of assembling a composite fan casing for a turbine engine, said method comprising:

providing a core including a plurality of core layers of reinforcing fiber bonded together with a resin, wherein the core includes a first surface and an opposing second surface; and coupling a shock dispersion panel to the first surface, the shock dispersion panel comprising a plurality of solid members having a solid exterior and a solid central interior, wherein the shock dispersion panel is configured to disperse a shock wave caused by an impact on the second surface to prevent separation of the plurality of core layers, and wherein the plurality of solid members extend radially outward from the first surface.

16. The method in accordance with claim 15, wherein coupling a shock dispersion panel to the first surface comprises coupling a shock dispersion panel that includes a plurality of panel layers of reinforcing fiber bonded together with the resin such that the shock dispersion panel and the core are formed from the same material.

17. The method in accordance with claim 15, wherein coupling a shock dispersion panel to the first surface comprises coupling a shock dispersion panel that includes a sawtooth-shaped cross-section.

18. The fan casing in accordance with claim 10, wherein the shock dispersion panel is formed from a first material having a first acoustic impedance and the core is formed from a second material having a second acoustic impedance that is the same as the first acoustic impedance, and wherein with the shock wave traveling through the core, the shock wave travels past the outer surface of the core into the shock dispersion panel which disperses the shock wave caused by the impact on the inner surface to prevent separation of the plurality of core layers.

19. The fan casing in accordance with claim 10, wherein the core is formed from an alternating arrangement of the resin and the plurality of core layers.

20. The fan casing in accordance with claim 19, wherein the solid central interior does not include any hollow portions, and wherein the solid members are formed from a second alternating arrangement of the resin and the layers of reinforcing fiber.

* * * * *